US011583030B2

(12) United States Patent
Campos, II et al.

(10) Patent No.: US 11,583,030 B2
(45) Date of Patent: Feb. 21, 2023

(54) SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Wesley K. Chan, Portland, OR (US); Zachary M. Elder, Portland, OR (US); Elizabeth Langvin, Sherwood, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/771,943

(22) PCT Filed: Dec. 12, 2018

(86) PCT No.: PCT/US2018/065070

§ 371 (c)(1),
(2) Date: Jun. 11, 2020

(87) PCT Pub. No.: WO2019/118533

PCT Pub. Date: Jun. 20, 2019

(65) Prior Publication Data

US 2020/0390189 A1 Dec. 17, 2020

Related U.S. Application Data

(60) Provisional application No. 62/598,822, filed on Dec. 14, 2017.

(51) Int. Cl.

| | |
|---|---|
| ***A43B 13/18*** | (2006.01) |
| ***A43B 21/28*** | (2006.01) |
| ***A43B 13/20*** | (2006.01) |

(52) U.S. Cl.

CPC ..... *A43B 13/189* (2013.01); *A43B 13/206* (2013.01); *A43B 21/28* (2013.01)

(58) Field of Classification Search

CPC ..... A43B 18/189; A43B 13/20; A43B 13/206; A43B 21/28; A43B 13/186; A43B 13/203;

(Continued)

(56) References Cited

U.S. PATENT DOCUMENTS 3,795,994 A * 3/1974 Ava ..... A43B 17/03 36/29
4,547,978 A * 10/1985 Radford ..... A43B 13/20 36/29

(Continued)

FOREIGN PATENT DOCUMENTS

CN 106136442 A 11/2016
EP 2609824 A1 7/2013

(Continued)

OTHER PUBLICATIONS

European Patent Office (ISA), International Search Report and Written Opinion for International Application No. PCT/US2018/065070, dated May 13, 2019.

(Continued)

*Primary Examiner* — Jameson D Collier
(74) *Attorney, Agent, or Firm* — Honigman LLP; Matthew H. Szalach; Jonathan P. O'Brien

(57) ABSTRACT

A sole structure for an article of footwear having an upper includes a heel region, a forefoot region, and a mid-foot region disposed between the heel region and the forefoot region. The sole structure also includes a bladder including a first barrier layer cooperating with a second barrier layer to define a first chamber bounding a periphery of the heel region, and a second chamber extending from the mid-foot region through the forefoot region and including a plurality of segments extending from a medial side of the sole structure to a lateral side of the sole structure. Each of the segments of the second chamber includes a medial reservoir (Continued)

adjacent to the medial side and a lateral reservoir adjacent to the lateral side, the medial reservoir fluidly coupled to the lateral reservoir via a first conduit.

19 Claims, 9 Drawing Sheets

(58) Field of Classification Search
CPC ..... A43B 13/188; A43B 1/0072; A43B 17/03; A43B 17/035; A43B 3/0063
USPC ..... 36/29, 35 B, 153
See application file for complete search history.

(56) References Cited

U.S. PATENT DOCUMENTS

| | | | | |
|---|---|---|---|---|
| 7,752,772 | B2 * | 7/2010 | Hatfield | A43B 13/141 36/29 |
| 2004/0194343 | A1 * | 10/2004 | Kim | A43B 13/203 36/29 |
| 2005/0028404 | A1 * | 2/2005 | Marvin | A43B 13/203 36/45 |
| 2011/0131832 | A1 * | 6/2011 | Brandt | B29C 66/438 36/29 |
| 2013/0212909 | A1 * | 8/2013 | Bates | A43B 13/188 36/102 |
| 2014/0230276 | A1 * | 8/2014 | Campos, II | B29D 35/128 36/84 |
| 2014/0283413 | A1 | 9/2014 | Christensen et al. | |
| 2015/0272271 | A1 | 10/2015 | Campos, II et al. | |
| 2017/0020228 | A1 * | 1/2017 | Scofield | A43B 13/184 |
| 2017/0119095 | A1 | 5/2017 | Greene | |
| 2017/0119096 | A1 | 5/2017 | Greene | |
| 2017/0265564 | A1 * | 9/2017 | Peyton | B29D 35/148 |
| 2017/0265566 | A1 * | 9/2017 | Case | A43B 13/186 |
| 2018/0303201 | A1 * | 10/2018 | Greene | A43B 13/186 |
| 2021/0145622 | A1 * | 5/2021 | Riffel | A43B 3/00 |

FOREIGN PATENT DOCUMENTS

| | | | |
|---|---|---|---|
| WO | WO-2017160730 | A1 | 9/2017 |
| WO | WO-2017160946 | A1 | 9/2017 |

OTHER PUBLICATIONS

Chinese Office Action dated Apr. 28, 2021 for Application 201880088654.0.
Korean Intellectual Property Office, Office Action for application No. 10-2020-7020238 dated Sep. 14, 2021.

* cited by examiner

SOLE STRUCTURE FOR ARTICLE OF FOOTWEAR

CROSS-REFERENCE TO RELATED APPLICATIONS

This application is the national phase of PCT International Application No. PCT/US2018/065070, filed Dec. 12, 2018, which claims priority to U.S. Provisional Ser. No. 62/598,822, filed Dec. 14, 2017, the contents of which are hereby incorporated by reference in their entireties.

FIELD

The present disclosure relates generally to sole structures for articles of footwear and more particularly to sole structures incorporating a fluid-filled bladder having a plurality of segments.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
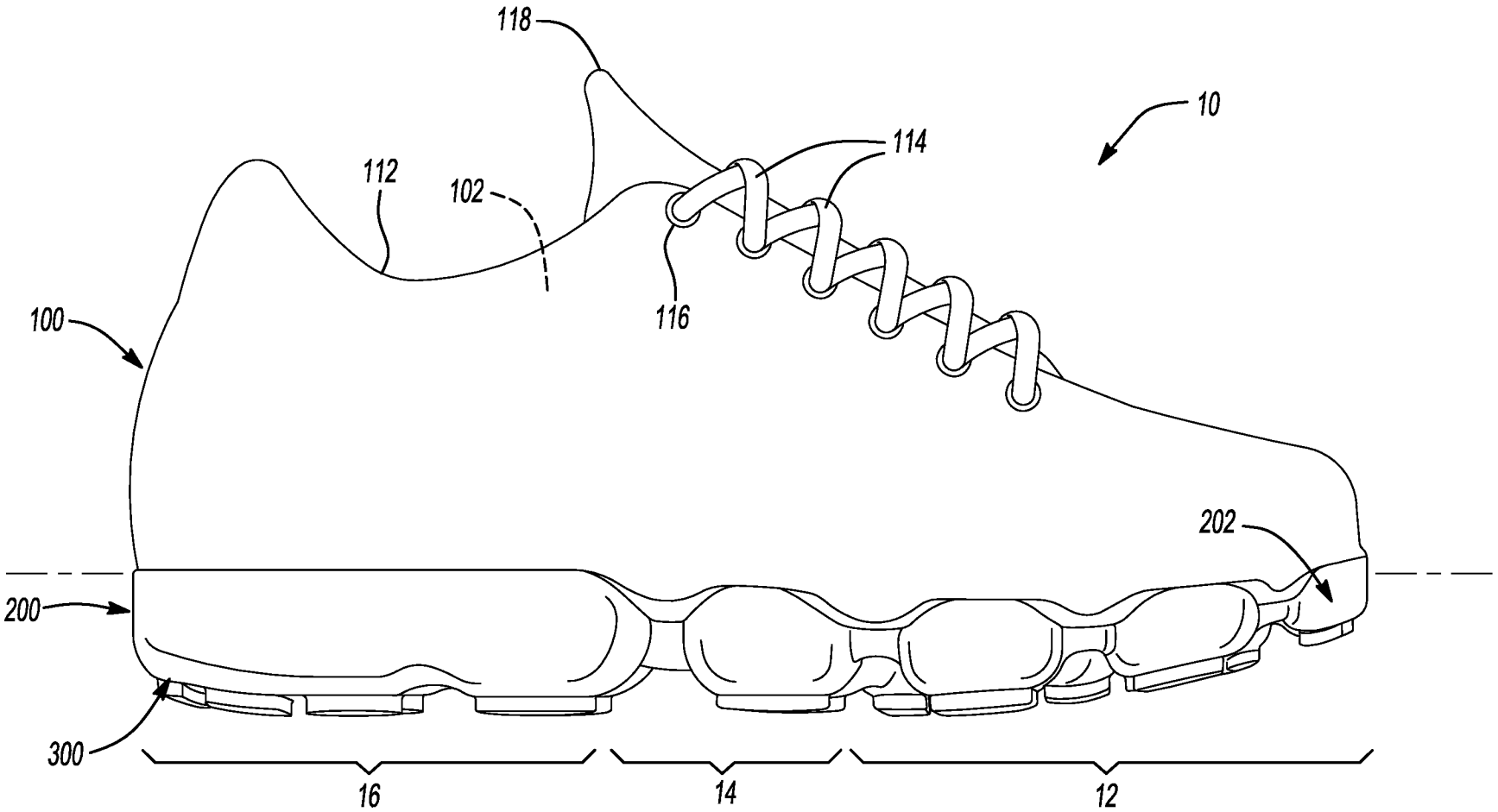
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having an upper. The sole structure includes a heel region, a forefoot region including a toe portion, and a mid-foot region disposed between the heel region and the forefoot region. The sole structure also includes a bladder including a first barrier layer cooperating with a second barrier layer to define a first chamber bounding a periphery of the heel region, and a second chamber extending from the mid-foot region through the forefoot region and including a plurality of segments extending from a medial side of the sole structure to a lateral side of the sole structure and including a plurality of reservoirs.

Implementations of the disclosure may include one or more of the following optional features. In some implementations, each of the segments of the second chamber includes a medial reservoir adjacent to the medial side and a lateral reservoir adjacent to the lateral side, the medial reservoir fluidly coupled to the lateral reservoir via a first conduit. Each of the segments may also include a central reservoir disposed between the medial reservoir and the lateral reservoir. The sole structure may also include an outsole attached to the bladder and including a plurality of contact pads, each of the contact pads may be formed on one of the reservoirs. The medial reservoir may be fluidly coupled to the central reservoir via the first conduit and the lateral reservoir may be coupled to the central reservoir via a second conduit.

In some examples, the medial reservoir defines a prolate hemispheroid shape having a major axis extending in a direction along the medial side, the lateral reservoir defines a prolate hemispheroid shape having a major axis extending in a direction along the lateral side, and the central reservoir defines a prolate hemispheroid shape having a major axis intersecting the major axis of the medial reservoir and the major axis of the lateral reservoir. Here, the plurality of segments may include a first segment, a second segment, and a third segment, the second segment disposed intermediate the first segment and the third segment along a longitudinal direction. The central reservoir of the third segment may be disposed between the medial reservoir and the lateral reservoir of the second segment. Optionally, the central reservoir of the second segment may be disposed between the medial reservoir and the lateral reservoir of the first segment. The medial reservoir of the first segment may be fluidly coupled to the medial reservoir of the second segment by a third conduit and the lateral reservoir of the first segment is fluidly coupled to the lateral reservoir of the second segment by a fourth conduit.

Another aspect of the disclosure provides a sole structure for an article of footwear having an upper. The sole structure includes a heel region, a forefoot region including a toe portion, and a mid-foot region disposed between the heel region and the forefoot region. The sole structure also includes a first chamber extending from the mid-foot region through the forefoot region and including a plurality of ribs extending from a medial side of the sole structure to a lateral side of the sole structure, each of the ribs including a medial reservoir formed along a medial side of the sole structure, a lateral reservoir formed along a lateral side of the sole structure, and a central reservoir disposed between the medial reservoir and the lateral reservoir.

Aspects of this disclosure may include one or more of the following optional features. In some configurations, the medial reservoir of each of the ribs defines a major axis extending along the medial side of the sole structure, the lateral reservoir of each of the ribs defines a major axis extending along the lateral side of the sole structure, and the central reservoir of each of the ribs defines a major axis extending transvers to a longitudinal axis of the sole structure. Each of the ribs may include a lateral conduit fluidly coupling the central reservoir to the lateral reservoir and a medial conduit fluidly coupling the central reservoir to the medial reservoir.

In some implementations, the first chamber includes a first rib, a second rib, and a third rib, whereby the second rib is disposed between the first rib and the second rib along a longitudinal axis of the sole structure. Here, the lateral reservoir of the first rib may be fluidly coupled to the lateral reservoir of the second rib by a first conduit and the lateral reservoir of the second rib may be fluidly coupled to the lateral reservoir of the third rib by a second conduit. Optionally, the medial reservoir of the first rib may be fluidly coupled to the medial reservoir of the second rib by a third conduit and the medial reservoir of the second rib may be fluidly coupled to the medial reservoir of the third rib by a fourth conduit.

In some examples, the central reservoir of a first one of the ribs is disposed between the medial reservoir and the lateral reservoir of a second one of the ribs. A major axis defined by the central reservoir of one of the ribs may be disposed forward of minor axes defined by the medial reservoir and the lateral reservoir of the one of the ribs.

In some configurations, the first chamber also includes a first segment extending around the forefoot region from the medial side to the lateral side and coupled to the medial reservoir of a first one of the ribs by a first conduit and the lateral reservoir of the first one of the ribs by a second conduit. Here, the sole structure may further include a second chamber surrounding the heel region and a third chamber disposed intermediate the first chamber and the second chamber in the mid-foot region of the sole structure.

Figure 2:
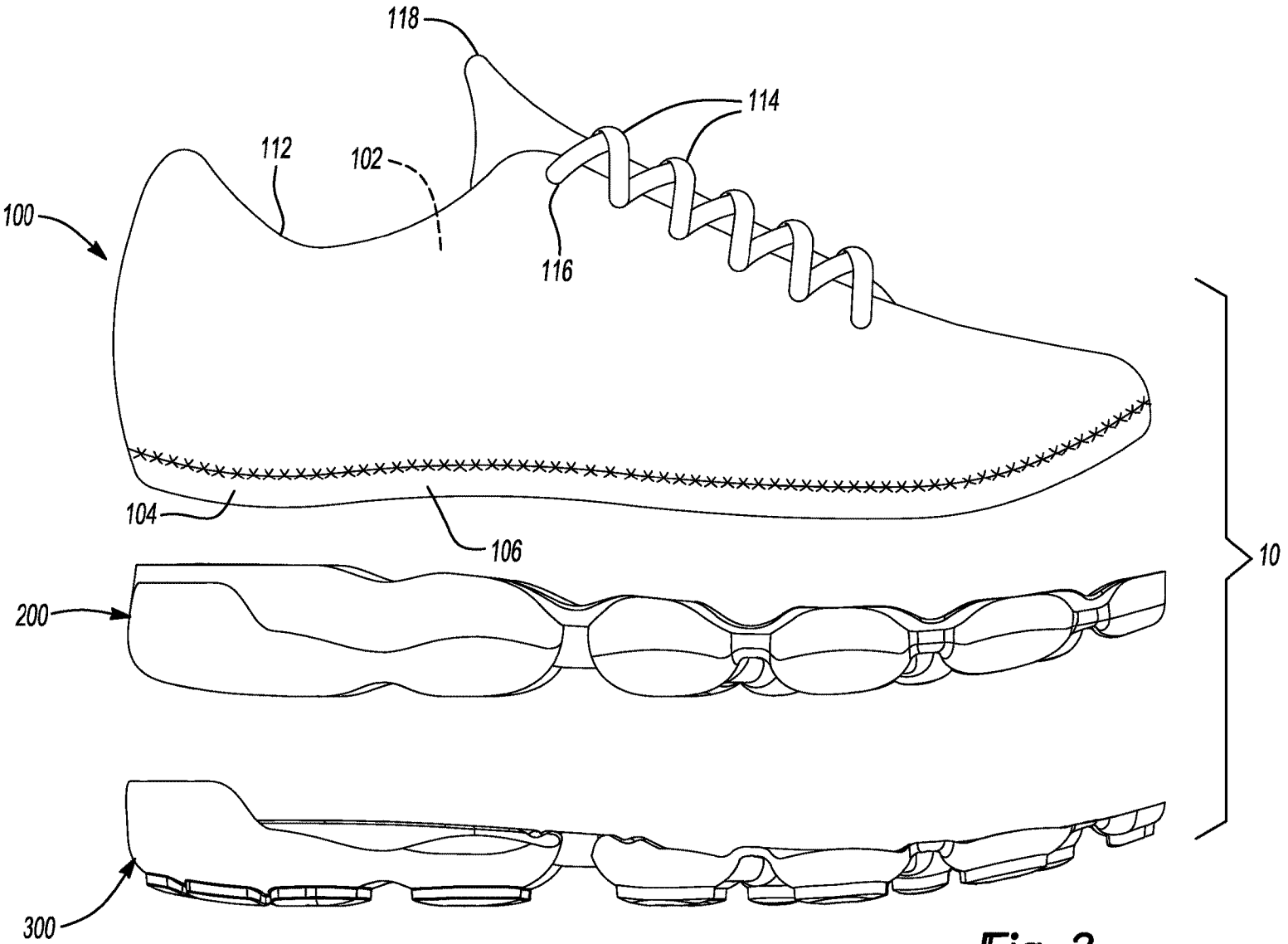
FIG. 2 is an exploded view of the article of footwear of FIG. 1 showing an article of footwear having an upper, a midsole, and an outsole arranged in a layered configuration.

Referring to FIGS. 1 and 2, an article of footwear 10 includes an upper 100, a midsole 200 attached to the upper 100, and an outsole 300 extending between the midsole 200 and a ground surface. The article of footwear 10 may be divided into one or more regions. The regions may include a forefoot region 12, a mid-foot region 14, and a heel region 16. The forefoot region 12 may correspond with toes and joints connecting metatarsal bones with phalanx bones of a foot. The mid-foot region 14 may correspond with an arch area of the foot, and the heel region 16 may correspond with rear portions of the foot, including a calcaneus bone. The footwear 10 may include lateral and medial sides 18, 20, respectively, corresponding with opposite sides of the footwear 10 and extending through the regions 12, 14, 16.

The upper 100 includes interior surfaces that define an interior void 102 configured to receive and secure a foot for support on the midsole 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 4:
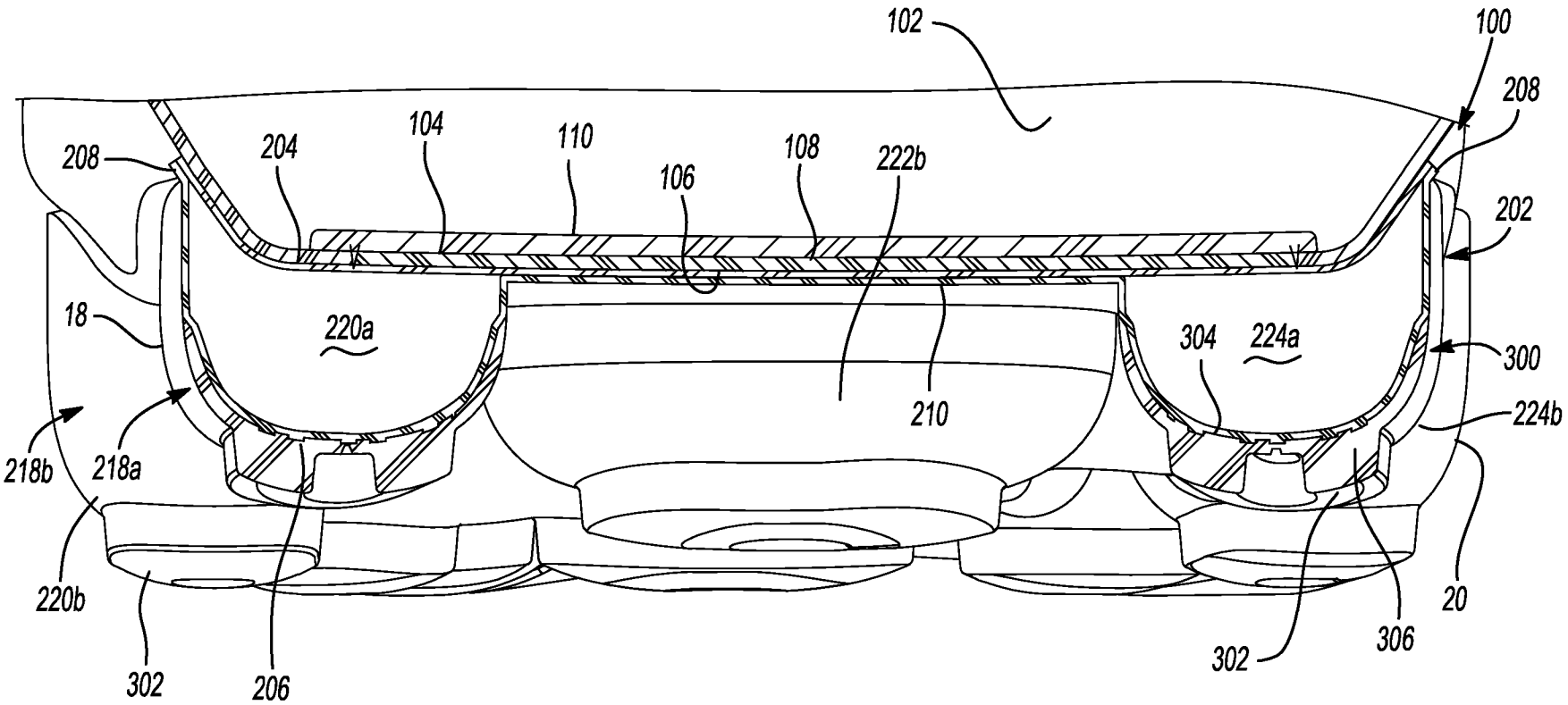
FIG. 4 is a cross-sectional view taken along line 4-4 of FIG. 3 showing segments disposed within a forefoot region of the sole structure and separated from one another by a web area.

In some examples, the upper 100 includes a strobel 104 having a bottom surface 106 opposing the midsole 200 and an opposing top surface defining a footbed 108 of the interior void 102. Stitching or adhesives may secure the strobel 104 to the upper 100. As shown in FIG. 4, the footbed 108 may be contoured to conform to a profile of the bottom surface (e.g., plantar) of the foot. Optionally, the upper 100 may also incorporate additional layers such as an insole 110 or sockliner that may be disposed upon the strobel 104 and reside within the interior void 102 of the upper 100 to receive a plantar surface of the foot to enhance the comfort of the article of footwear 10. An ankle opening 112 in the heel region 16 may provide access to the interior void 102. For example, the ankle opening 112 may receive a foot to secure the foot within the void 102 and facilitate entry and removal of the foot from and to the interior void 102.

In some examples, one or more fasteners 114 extend along the upper 100 to adjust a fit of the interior void 102 around the foot and to accommodate entry and removal of the foot therefrom. The upper 100 may include apertures 116 such as eyelets and/or other engagement features such as fabric or mesh loops that receive the fasteners 114. The fasteners 114 may include laces, straps, cords, hook-and-loop, or any other suitable type of fastener. The upper 100 may include a tongue portion 118 that extends between the interior void 102 and the fasteners 114.

As illustrated in FIGS. 4-7, the midsole 200 includes a bladder 202 defined by an upper barrier layer 204 (hereinafter 'upper layer 204') and a lower barrier layer 206 (hereinafter 'lower layer 206'). The upper layer 204 and the lower layer 206 define barrier layers for the bladder 202 by joining together and bonding at a plurality of discrete locations during a molding or thermoforming process to form a flange 208 extending around the periphery of the midsole 200 and a web area 210 extending between the lateral and medial sides 18 and 20 of the midsole 200. The flange 208 and the web area 210 are disposed proximate to the upper 100 and, thus, are recessed relative to a ground-engaging surface 302 of the outsole 300.

The upper layer 204 of the bladder 202 opposes and attaches (e.g., joins and bonds) to the bottom surface 106 of the strobel 104 of the upper 100. Additionally, the upper layer 204 of the bladder 202 may be contoured to conform to a profile of the bottom surface of the foot to provide cushioning and support for the foot. The upper layer 204 may be formed from one or more polymer materials during a molding process or a thermoforming process and may include an outer peripheral edge that extends upward upon an outer periphery of the upper 100. The lower layer 206 of the bladder 202 is disposed on an opposite side of the bladder 202 than the upper layer 204. The lower layer 206 may include an outer peripheral edge that extends upward toward the upper 100 and bonds with the outer peripheral edge of the upper layer 204 to form the flange 208. As with the upper layer 204, the lower layer 206 may be formed from the same or a different material than the upper layer 204 during the molding or thermoforming process.

In some implementations, the upper and lower layers 204, 206 are formed by respective mold portions each defining various surfaces for forming depressions and pinched surfaces corresponding to locations where the flange 208 and/or the web area 210 are formed when the lower layer 206 and the upper layer 204 join and bond together. In some implementations, adhesive bonding joins the upper layer 204 and the lower layer 206 to form the flange 208 and the web area 210. In other implementations, the upper layer 204 and the lower layer 206 are joined to form the flange 208 and the web area 210 by thermal bonding. In some examples, one or both of the upper and lower layers 204, 206 are heated to a temperature that facilitates shaping and melding. In some examples, the layers 204, 206 are heated prior to being located between their respective molds. In other examples, the mold may be heated to raise the temperature of the layers 204, 206. In some implementations, a molding process used to form the bladder 202 incorporates vacuum ports within mold portions to remove air such that the upper and lower layers 204, 206 are drawn into contact with respective mold portions. In other implementations, fluids such as air may be injected into areas between the upper and lower layers 204, 206 such that pressure increases cause the layers 204, 206 to engage with surfaces of their respective mold portions.

In some implementations, the midsole 200 may include a polymer foam layer (not shown) disposed between the upper layer 204 of the bladder 202 and the upper 100. Thus, the optional foam layer of the midsole 200 is operative as an intermediate layer to indirectly attach the upper layer 204 of the bladder 202 to the upper 100 by joining the upper layer 204 of the bladder 202 to the upper 100 and/or to the bottom surface 106 of the strobel 104. The optional foam layer may also join the lower layer 206 to the outsole 300, thereby securing the midsole 200 and the outsole 300 to the upper 100. Moreover, the foam layer of the footwear 10 may also reduce the extent to which the upper layer 204 extends onto the peripheral surfaces of the upper 100 and, therefore, increases durability of the footwear 10 by reducing the possibility of the upper layer 204 detaching from the upper 100 over extended use of the footwear 10.

In some implementations, an overmold portion extends over a portion of the bladder 202 to provide increased durability and resiliency for the chambers 212, 214, 216 when under applied loads. The overmold portion may extend over the forefoot region 12, the mid-foot region 14, and/or the heel region 16 by attaching to the lower layer 206 to provide increased durability and resiliency for the bladder 202 where the separation distance between the lower layer 206 and the upper layer 204 are larger, or to provide increased thickness in specific areas of the bladder, such as the heel region 16. In some examples, the overmold portion is bonded to the lower layer 206 and includes at least one of a different thickness, a different hardness, and a different material than the lower layer 206. The overmold portion may limited to only areas of the lower layer 206 that partially define the segments residing in the heel and mid-foot regions 16 and 14 and, therefore, the overmold portion may be absent from the flange 208 and web area 210.

In some examples, the outsole 300 includes the ground-engaging surface 302 and an opposite inner surface 304 that attaches to regions of the lower layer 206 that define the chambers 212, 214, 216. Accordingly, the outsole 300 may include a plurality of segments each defining a shape that conforms to the shape of a respective chambers 212, 214, 216, whereby the outsole 300 is absent in regions between the chambers 212, 214, 216 to thereby expose the flange 208 and web area 210 of the bladder 202. The outsole 300 generally provides abrasion-resistance and traction with the ground surface and may be formed from one or more materials that impart durability and wear-resistance, as well as enhance traction with the ground surface. For example, rubber may form at least a portion of the outsole 300.

Figure 8:
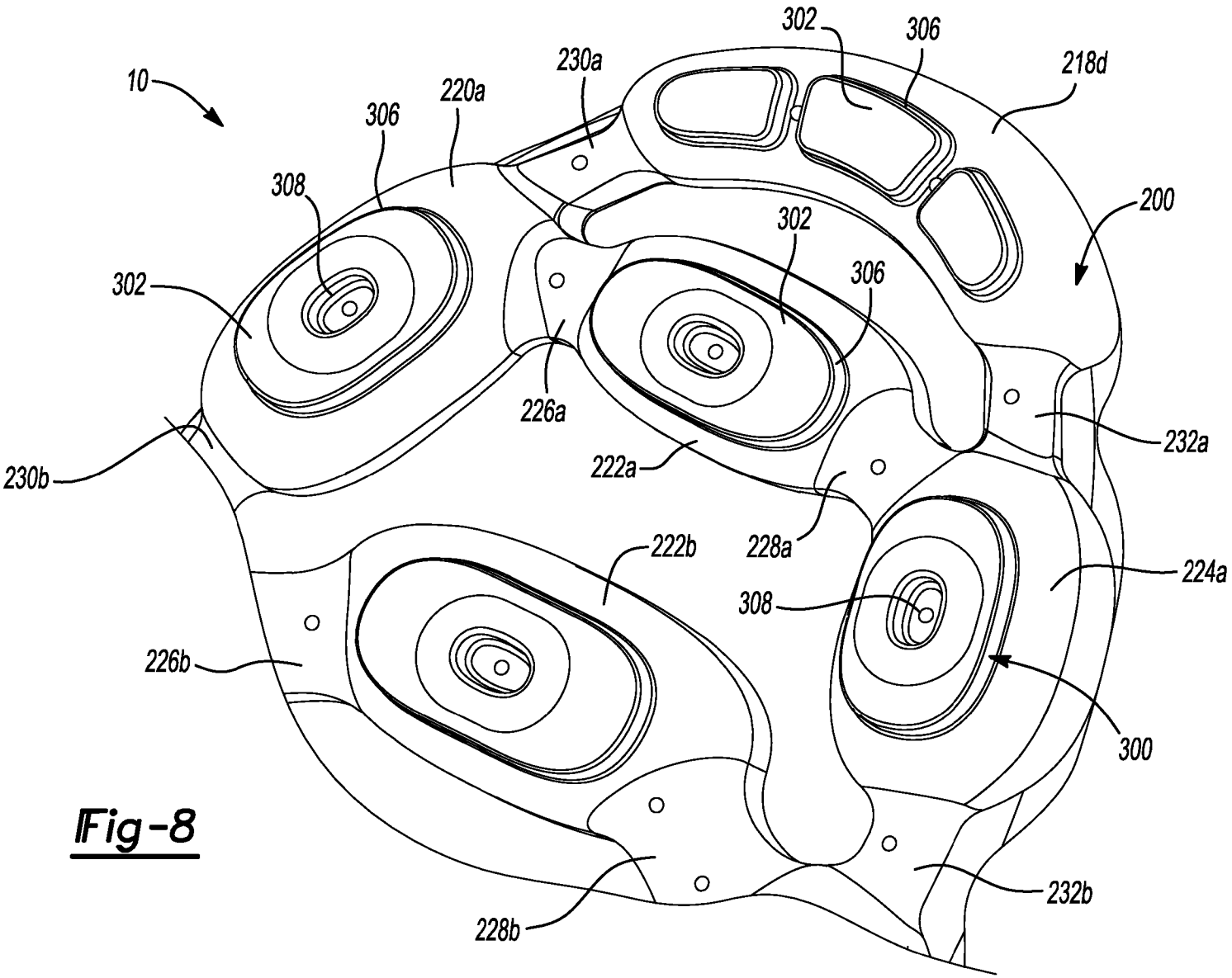
FIG. 8 is a perspective view of a first chamber of a bladder having an outsole attached thereto.

The ground-engaging surface 302 of the outsole 300 may be defined by a plurality of contact pads 306. In some examples, the contact pads 306 extend from the lower layer 206 of the bladder 202 in a direction away from the upper 100 to provide increased traction with the ground surface. The contact pads 306 may have a corresponding shape to the ground-engaging surface 302 of the outsole 300. For example, one of the contact pads 306 may be formed on each of the reservoirs 220, 222, 224 and may have an oval or obround shape corresponding to the prolate hemispheroidal shape of one or more of the reservoirs 220, 222, 224. The contact pads 306 may also cause the bottom surface of the foot to reside higher above the ground surface. With reference to FIG. 8, the contact pads 306 may include recesses or voids 308 to impart properties of improved traction and responsiveness.

In the illustrated example, the outsole 300 is formed as the overmold portion, as described above. Accordingly, the outsole 300 may be formed integrally with the lower layer 206 of the bladder 202 using an overmolding process. In other examples the outsole 300 may be formed separately from the lower layer 206 of the bladder 202 and adhesively bonded to the lower layer 206.

Figure 3:
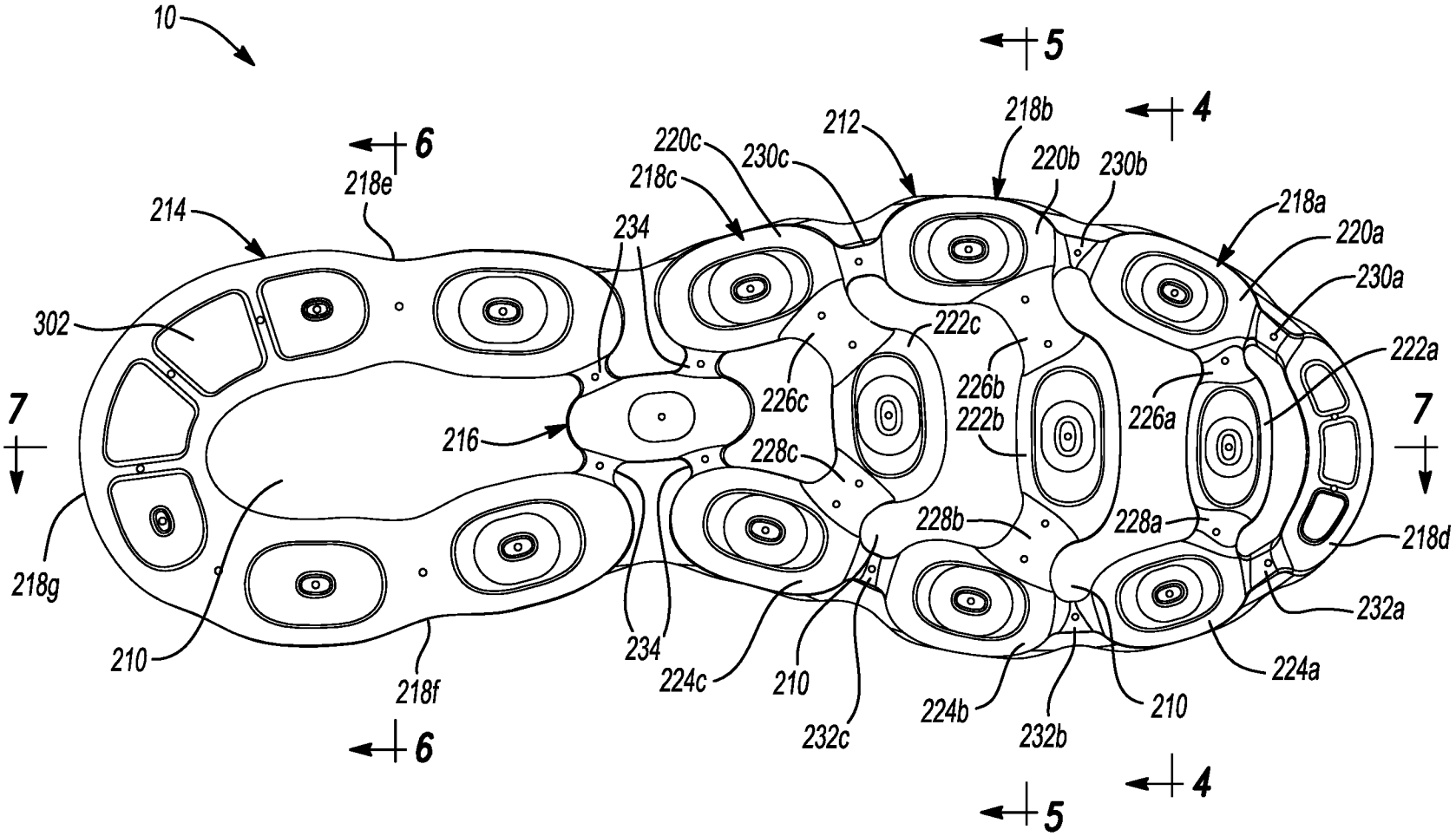
FIG. 3 is a bottom perspective view of the article of footwear of FIG. 1 showing a geometry and configuration of a plurality of segments associated with a bladder of a sole structure.

Referring to FIG. 3, the bladder 202 includes one or more chambers 212, 214, 216. In the illustrated example, a first chamber 212 extends from the mid-foot region 14 to a toe portion of the forefoot region 12, a second chamber 214 extends through the heel region 16, and a third chamber 216 is disposed within the mid-foot region between the first chamber 212 and the second chamber 216. In the illustrated example, the first chamber 212 is fluidly coupled to the second chamber 214 indirectly via the third chamber 216. Additionally or alternatively, the first chamber 212 may be directly fluidly coupled to the second chamber 214.

In some implementations, the lower layer 206 defines a geometry (e.g., thicknesses, width, and lengths) of the plurality of chambers 212, 214, 216. The lower layer 206 and the upper layer 204 may join and bond together in a plurality of discrete areas between the lateral side 18 and the medial side 20 of the bladder 202 to form portions of the web area 210 that bound and separate the chambers 212, 214, 216. Thus, each chamber 212, 214, 216 is associated with an area of the bladder 202 where the upper and lower layers 204, 206 are not joined together and, thus, are separated from one another to form respective voids.

The flange 208 and the web area 210 may cooperate to bound and extend around each of the chambers 212, 214, 216 to contain the fluid (e.g., air) within the bladder 202. In some examples, regions of the web area 210 are bounded entirely by the chambers 212, 214, 216, and define flexion zones to facilitate flexing of the footwear 10 as the midsole 200 rolls along the ground surface. As shown in FIG. 3, no portion of the web area 210 extends continuously between the lateral side 18 and the medial side 20.

Figure 5:
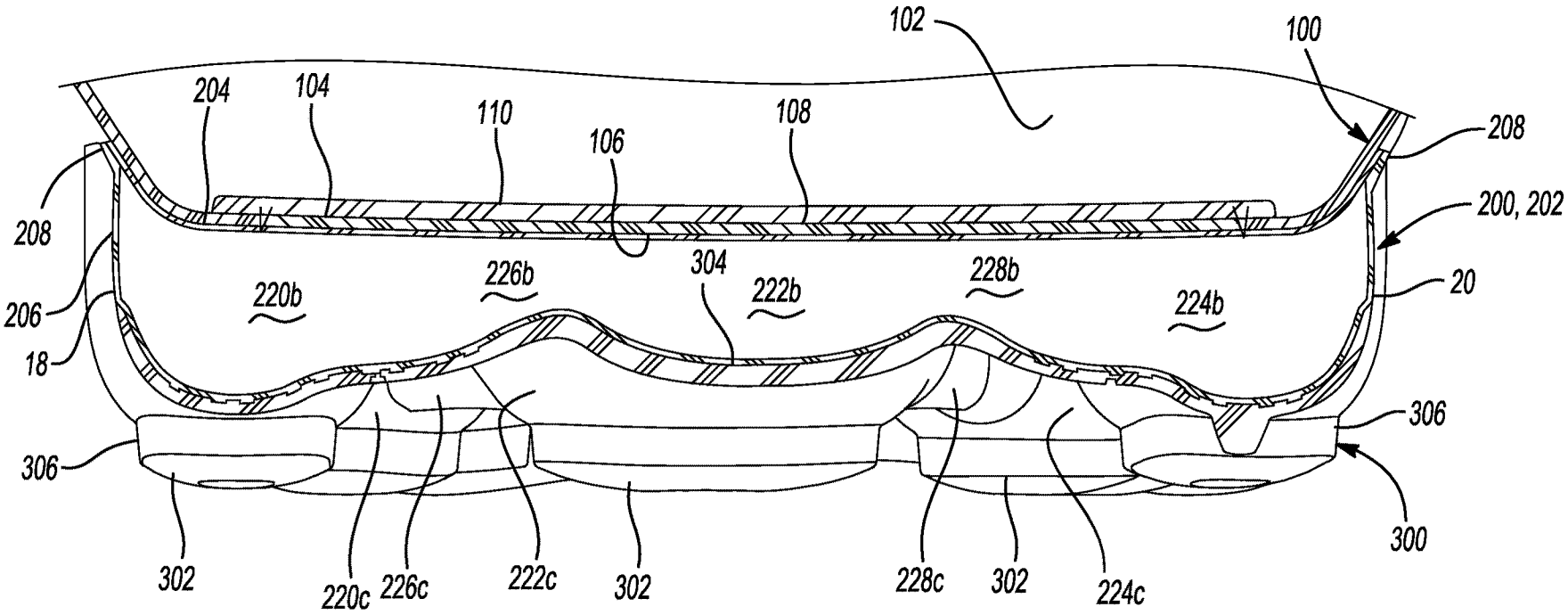
FIG. 5 is a cross-sectional view taken along line 5-5 of FIG. 3 showing segments disposed within a forefoot region of the sole structure and separated from one another by a web area.
Figure 6:
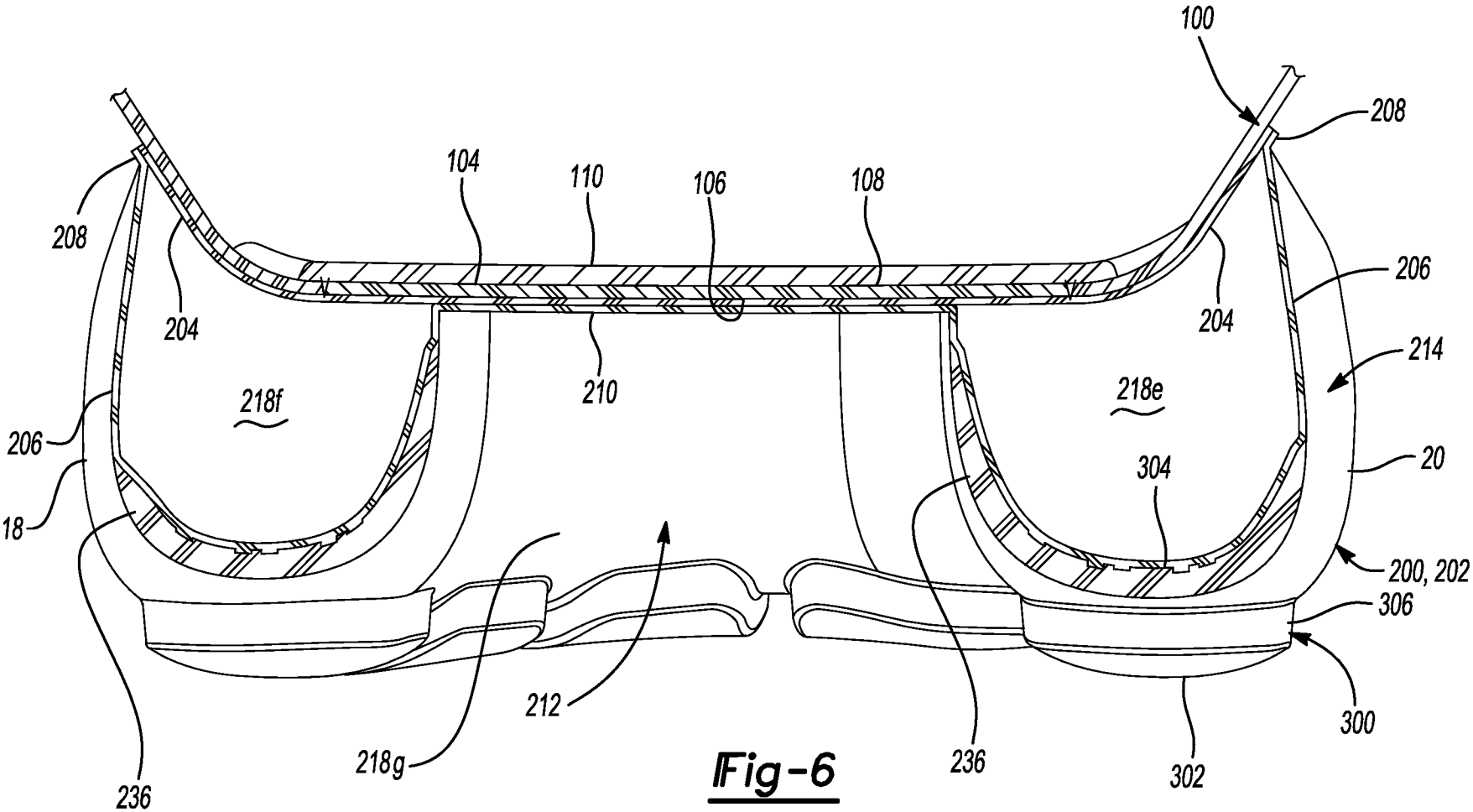
FIG. 6 is a cross-sectional view taken along line 6-6 of FIG. 3 showing segments disposed within a forefoot region of the sole structure and separated from one another by a web area.
Figure 7:
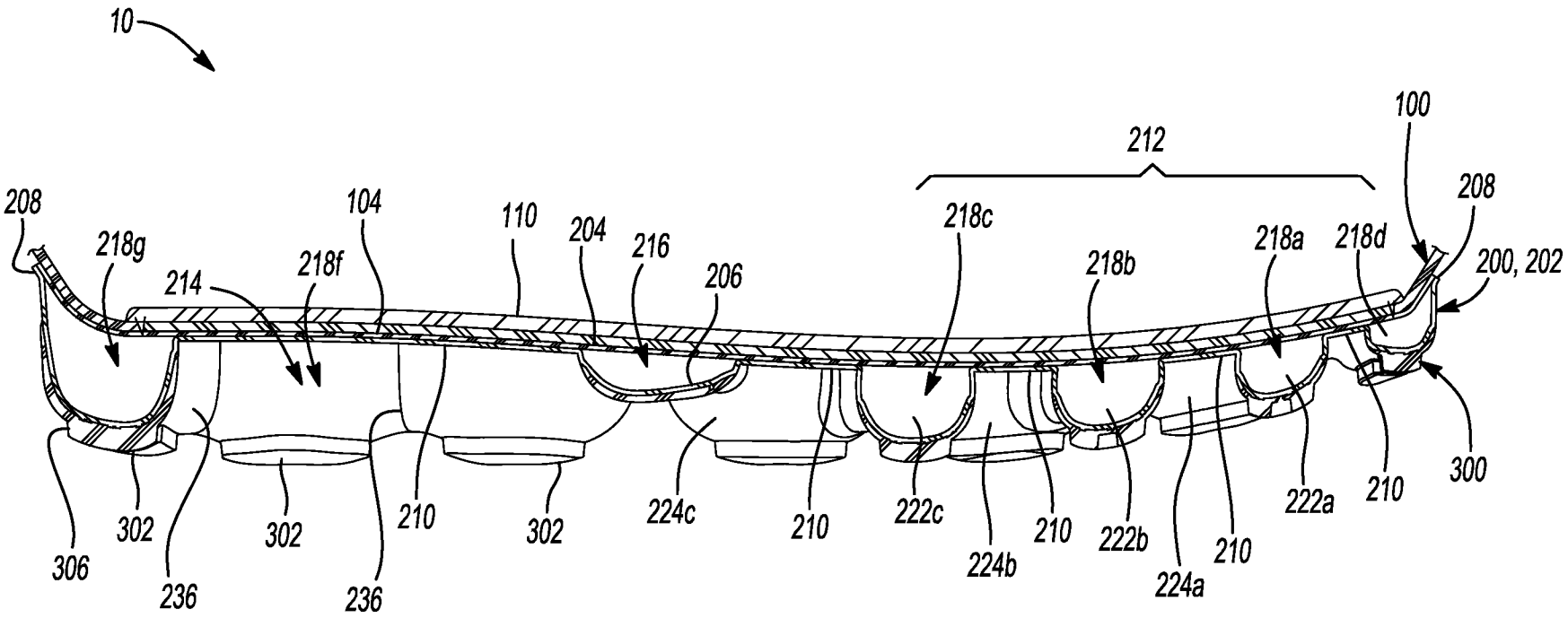
FIG. 7 is a cross-sectional view taken along line 7-7 of FIG. 3 showing an overmolded outsole attached to segments along a length of the sole structure.

With reference to FIGS. 4-7, each chamber 212, 214, 216 may define a substantially tubular cross-sectional shape and a thickness that extends substantially perpendicular to the longitudinal axis L of the midsole 200 between the upper layer 204 and the lower layer 206. As such, the thickness of each chamber 212, 214, 216 is defined by a distance the lower layer 206 protrudes away from the upper layer 204 in a direction away from the upper 100. At least two of the segments **218*a*-218*g* of the first and second chambers 212, 214 may define different thicknesses. For example, the segments 218*e*-218*g* disposed in the heel region 16 may be associated with greater thicknesses than thicknesses associated one or more of segments 218*a*-218*d* disposed in the forefoot region 12. Further, the thickness within any of the segments 218*a*-218*e* may be variable, such that a first portion of one of the segments 218*a*-218*e* has a different thickness from a second portion of the one of the segments 218*a*-218*e*. As shown in FIG. 7, a thickness of the midsole 200 gradually decreases from the heel region 16 to the forefoot region 12 to provide a greater degree of cushioning for absorbing ground-reaction forces of greater magnitude that initially occur in the heel region 16 and lessen as the forefoot region 12 of the midsole 200 rolls for engagement with the ground surface. In some examples, the third chamber 216 is disposed in the mid-foot region 14 and is associated with a lesser thickness than the first chamber 212 and the second chamber 214, such that the lower layer 206 is recessed from the ground-engaging surface 302 of the outsole 300**.

Each of the chambers 212, 214, 216 may be filled with a pressurized fluid (i.e., gas, liquid) to provide cushioning and stability for the foot during use of the footwear 10. In some implementations, compressibility of a first portion of the chambers 212, 214, 216 under an applied load provides a responsive-type cushioning, while a second portion of the chambers 212, 214, 216 may be configured to provide a soft-type cushioning under an applied load. Accordingly, the chambers 212, 214, 216 of the bladder 202 may cooperate to provide gradient cushioning to the article of footwear 10 that changes as the applied load changes (i.e., the greater the load, the more the chambers 212, 214, 216 are compressed and, thus, the more responsive the footwear 10 performs).

In other implementations, one or more cushioning materials, such as polymer foam and/or particulate matter (none shown), are enclosed by one or more of the chambers 212, 214, 216 in place of, or in addition to, the pressurized fluid to provide cushioning for the foot. In these implementations, the cushioning materials may provide portions of one or more of the chambers 212, 214, 216 with cushioning properties different from portions of the chambers 212, 214, 216 filled with the pressurized fluid. For example, the cushioning materials may be more or less responsive or provide greater impact absorption than the pressurized fluid.

With reference to FIG. 3, the geometry and configuration of the chambers 212, 214, 216 is shown with reference to a bottom perspective view of the footwear 10. As described above, the chambers 212, 214, 216 are formed in areas of the midsole 200 where the upper layer 204 and the lower layer 206 are separated and spaced apart from one another to define respective voids for enclosing the pressurized fluid or cushioning material. As such, the flange 208 and the web area 210 correspond to areas of the bladder 202 where the upper layer 204 and the lower layer 206 are joined and bonded, and cooperate to bound and define a perimeter of each chamber 212, 214, 216 to thereby seal the pressurized fluid therein.

In some implementations, the chambers 212, 214, 216 are in fluid communication with one another to form a unitary pressure system for the bladder 202. The unitary pressure system directs the fluid through the chambers 212, 214, 216 when under an applied load as the chambers 212, 214, 216 compress or expand to provide cushioning, as well as stability and support, by attenuating ground-reaction forces especially during forward running movements of the footwear 10. Optionally, a portion of one or more of the chambers 212, 214, 216 may be fluidly isolated from the other chambers 212, 214, 216 so that at least one of the segments 218*a*-218*g* can be pressurized differently.

In some examples, the first chamber 212 includes a plurality of segments 218*a*-218*d* spaced from the forefoot region 12 to the mid-foot region of the midsole 200, and extending from the lateral side 18 to the medial side 20. As shown, the segments 218*a*-218*d* of the first chamber 212 define U-shaped ribs extending continuously from the lateral side 18 of the midsole 200 to the medial side 20 of the midsole 200. In one example, the first chamber 212 includes three segments 218*a*-218*c* spaced from the forefoot region 12 to the mid-foot region 14 and a fourth segment 218*d* extending continuously around the toe portion of the forefoot region 12. Each of the segments 218*a*-218*c* includes a plurality of discretely formed reservoirs 220, 222, 224 connected with each other by conduits 226, 228, as described below.

Each of the segments 218*a*-218*c* includes a lateral reservoir 220*a*-220*c* disposed adjacent the lateral side 18 of the midsole 200, a central reservoir 222*a*-222*c* disposed between the lateral side 18 and the medial side 20, and a medial reservoir 224-224*c* disposed adjacent the medial side 20 of the midsole 200. The lateral reservoirs 220*a*-220*c* of each of the segments 218*a*-218*c* define prolate hemispheroids having a major axis $30a_1$-$30c_1$ extending in a direction along the lateral side 18 of the midsole 200. Likewise, the medial reservoirs 224*a*-224*c* of each of the segmented segments 218*a*-218*c* may also define prolate hemispheroids having major axes $30a_3$-$30c_3$ extending in a direction along the medial side 20 of the midsole 200. The central reservoir 222*a*-222*c* of each segment 218*a*-218*c* defines a prolate hemispheroid having a major axis $30a_2$-$30c_2$ extending transverse to each of the lateral side 18 and the medial side 20. More particularly, the major axis of each of the central reservoirs 222*a*-222*c* is substantially perpendicular to the longitudinal axis L of the footwear 10.

The first chamber 212 further includes the fourth segment 218*d* extending around a toe portion of the forefoot region 12, from a first end on the lateral side 18 to a second end on the medial side 20. In one example, the fourth segment 218*d* is a continuously-formed, fluid-filled segment. In other examples, the fourth segment 218*d* may include distinct reservoirs similar to the segments 218*a*-218*c* of the first chamber 212.

Referring still to FIG. 3, the first chamber 212 includes a plurality of conduits 226, 228, 230, 232 fluidly coupling the reservoirs 220, 222, 224. Each of the segments 218*a*-218*c* includes a respective lateral conduit 226*a*-226*c* fluidly coupling the lateral reservoir 220*a*-220*c* to the central reservoir 222*a*-222*c*, and a respective medial conduit 228*a*-228*c* fluidly coupling the medial reservoir 224*a*-224*c* to the central reservoir 222*a*-222*c*.

In addition to the reservoirs 220, 222, 224 of each one of the respective segments 218*a*-218*c* being fluidly coupled to each other, the adjacent ones of the segments 218*a*-218*d* are fluidly coupled to each other along the lateral side 18 and the medial side 20 by a plurality of longitudinal conduits 230*a*-230*f*. For example, the lateral end of the segment 218*d* is coupled to the first lateral reservoir 220*a* of the first segment 218*a* by a first longitudinal conduit 230*a* and the medial end of the segment 218*d* is coupled to the first medial reservoir 224*a* by a second longitudinal conduit 232*a*. Similarly, the first lateral reservoir 220*a* is fluidly coupled to the second lateral reservoir 220*b* by a third longitudinal conduit 230*b* and the first medial reservoir 224*a* is fluidly coupled to the second medial reservoir 224*b* by a fourth longitudinal conduit 232*b*. Further, the second lateral reservoir 220*b* is fluidly coupled to the third lateral reservoir by a fifth longitudinal conduit 230*c*, and the second medial reservoir 224*b* is coupled to the third medial reservoir 224*c* by a sixth longitudinal conduit 232*c*. The longitudinal conduits extend in a direction substantially along the lateral and medial sides 18, 20 of the midsole 200. Additionally or alternatively, adjacent ones of the central reservoirs 222*a*-222*c* of each of the segments 218*a*-218*c* may be fluidly coupled to each other by conduits (not shown). In some examples, two or more of the lateral conduits 226 and/or the longitudinal conduits 228 of adjacent ones of the segments 218*a*-218*c* may be fluidly coupled to each other by sub-conduits (not shown).

In some examples, the segments 218*a*-218*c* and the reservoirs 220, 222, 224 are in fluid communication with one another to form a unitary pressure system for the first chamber 212. The unitary pressure system directs the fluid through the reservoirs 220, 222, 224 and conduits 226, 228, 230, 232 when under an applied load as the reservoirs 220, 222, 224 compress or expand to provide cushioning, as well as stability and support, by attenuating ground-reaction forces especially during forward running movements of the footwear 10. Optionally, one or more of the reservoirs 220, 222, 224 may be fluidly isolated from the other reservoirs 220, 222, 224 so that at least one of the segments 218*a*-218*d* or reservoirs 220, 222, 224 can be pressurized differently.

As shown in FIG. 3, the central reservoirs 222*a*-222*c* of each one of the segments 218*a*-218*c* are disposed closer to the toe of the footwear 10 than the respective lateral and medial reservoirs 220*a*-220*c*, 224*a*-220*c* of each segment 218*a*-218*c*. For example, the major axis $30a_2$-$30c_2$ of each of the central reservoirs 222*a*-222*c* is disposed forward of a minor axis $32a_1$-$32c_1$, $32a_3$-$32c_3$ of the respective lateral and medial reservoirs 220*a*-220*c*, 224*a*-220*c*. As such, each of the segments 218*a*-218*c* defines a horseshoe shape, opening towards the heel region 16 of the midsole 200. Further, the central reservoir 222*b* of the second segment 218*b* may be partially disposed between the lateral reservoir 220*a* and the medial reservoir 224*a* of the first segment 218*a*, while the central reservoir 222*c* of the third segment 218*c* is partially disposed between the lateral reservoir 220*b* and the medial reservoir 224*b* of the second segment 218*b*.

In some configurations, the second chamber 214 includes a series of connected segments 218*e*-218*g* surrounding the heel region 16 of the midsole 200. A fifth segment 218*e* extends along the lateral side 18 of the midsole 200 within the heel region 16, a sixth segment 218*f* extends along the medial side 20 of the midsole 200 within the heel region 16, and a seventh segment 218*g* extends around the heel region 16 and fluidly couples to the fifth and sixth segments 218*e*, 218*f*. Thus, the second chamber 214 may generally define a horse-shoe shape, wherein the seventh segment 218*g* couples to the fifth and sixth segments 218*e*, 218*f* at respective ones of the lateral side 18 and the medial side 20. In some examples, the sixth segment 218*f* includes a length greater than a length of the fifth segment 218*e*. For instance, the seventh segment 218*g* may extend farther along the lateral side towards the mid-foot region 14 than along the medial side 20. Accordingly, the sixth segment 218*f* may extend a greater distance along the medial side 20 of the heel region 16 of the midsole 200 than the fifth segment extends along the lateral side 18.

Each of the segments 218*e*-218*g* may be filled with a pressurized fluid to impart cushioning characteristics. However, as introduced above, at least one of the segments 218*e*-218*g* of the second chamber 214 may include one or more cushioning materials in place of, or in addition to, a pressurized fluid to provide cushioning and responsiveness different from the pressurized fluid of the other segments 218*e*-218*g*. For example, the seventh segment 218*g* may include the cushioning material in place of the fluid-filled chamber, such that the seventh segment 218*g* is configured to absorb an initial impact of the ground-reaction force.

As shown in FIG. 3, the third chamber 216 includes a fluid-filled reservoir disposed in the mid-foot region 14 of the sole structure, between the lateral side 18 and the medial side 20. In some examples, the third chamber 216 defines a prolate hemispheroid having a major axis 30*h* extending substantially along the longitudinal axis L of the midsole 200. A toe-facing end of the third chamber 216 is disposed between the lateral reservoir 220*c* and the medial reservoir 224*c* of the third segment 218*c*, and a heel-facing end of the third chamber 216 may be disposed between the fifth segment 218*e* and the sixth segment 218*f* of the second chamber 214.

The third chamber 216 is fluidly coupled to the first chamber 212 by a first pair of conduits 234. For example, a first conduit 234 fluidly couples the third chamber 216 directly to the third lateral reservoir 220*c* of the first chamber 212 and a second conduit 234 fluidly couples the third chamber 216 directly to the third medial reservoir 224*c* of the first chamber. Similarly, third and fourth conduits 234 fluidly couple the third chamber 216 directly to each of the fifth segment 218*e* and the sixth segment 218*f* of the second chamber 214.

FIG. 4 provides a cross-sectional view taken along line 4-4 of FIG. 3 showing the midsole 200 in the forefoot region 12 with the insole 110, the strobel 104 of the upper 100, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the medial side 20 and the lateral side 18. The lower layer 206 of the bladder 202 may also extend toward the upper 100 and join with the upper layer 204 to form a region of the web area 210 that extends between and separates the reservoirs 220*a*, 224*a*. For instance, the lateral reservoir 220*a* is bounded by the web area 210 and the flange 208 formed at the lateral side 18, while the medial reservoir 224*a* is bounded by the web area 210 and the flange 208 formed at the medial side 20.

The outsole 300 attaches to and conforms in shape with each of the reservoirs 220*a*, 224*a*. In some examples, the contact pad 306 extends from the outsole 300 in a direction away from the upper 100 and along respective lengths of the reservoirs 220*a*, 224*a* to provide increased traction with the ground surface.

FIG. 5 provides a cross-sectional view taken along line 5-5 of FIG. 3 showing the midsole 200 in the forefoot region 12 with the insole 110, the strobel 104 of the upper 100, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the medial side 20 and the lateral side 18. As shown, the lower layer 206 is spaced apart from the upper layer 204 from the lateral side 18 to the medial side 20. For instance, the lower layer 206 defines the lateral reservoir 220*b*, the lateral conduit 226*b*, the central reservoir 222*b*, the medial conduit 228*b*, and the medial reservoir 224*b* formed successively across the midsole 200 from the lateral side 18 to the medial side 20.

The outsole 300 attaches to and conforms in shape with each of the reservoirs 220*b*, 222*b*, 224*b*. In some examples, the contact pad 306 extends from the outsole 300 in a direction away from the upper 100 and along respective lengths of the reservoirs 220*a*, 224*a* to provide increased traction with the ground surface.

FIG. 6 provides a cross-sectional view taken along line 6-6 of FIG. 3 showing the midsole 200 in the heel region 16 with the insole 110, the strobel 104 of the upper 100, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the lateral side 18 and the medial side 20. Relative to the view of FIG. 6, the lower layer 206 protrudes away from the upper layer 204 in a direction away from the upper 100 to define the segments 218*e*, 218*f* that extend along respective ones of the lateral side 18 and the medial side 20.

In some implementations, the fifth segment 218*e* extending along the lateral side 18 and the sixth segment 218*f* extending along the medial side 20 each include semi-tubular cross-sectional shapes relative to the view of FIG. 6 to facilitate inward and/or outward rolling of the midsole 200 during lateral movements. Each of the segments 218*e*, 218*f* may further include a necked region 236 formed intermediate adjacent contact pads 306 and having a reduced thickness to allow the segments 218*e*, 218*f* to absorb the initial impact of a ground-reaction force and thereby compress before the ground-reaction force is applied to the necked region 236. As such a trampoline effect is created as the fluid-filled segments 218*e*, 218*f* compress in succession, thereby providing gradient responsive-type cushioning as the outsole 300 rolls for engagement with the ground surface.

FIG. 7 provides a cross-sectional view taken along line 7-7 of FIG. 3 showing the upper 100, the midsole 200, and the outsole 300 extending through forefoot region 12, the mid-foot region 14, and the heel region 16. As described above with reference to the footwear 10 of FIGS. 1 and 2, the outsole 300 attaches to portions of the lower layer 206 in regions where the chambers 212, 214 protrude away from the upper 100 to provide increased durability and resiliency for the bladder 202 in the heel region 16, the mid-foot region 14, and the forefoot region 12. Moreover, the segments 218*a*-218*d*, 218*g* extend between the lateral side 18 and the medial side 20. The web area 210 may separate and extend between the segments 218*a*-218*d*, 218*g* relative to the view of FIG. 7. In some examples, the segments 218*a*-218*d* extend into the forefoot region 12 and are associated with a smaller thickness than segments 218*e*-218*g* in the heel region 16 and/or mid-foot region 14.

FIG. 8 provides a bottom perspective view of the segments 218*a*, 218*b*, 218*d* fluidly connected to one another and disposed within the forefoot region 12 of the midsole 200. In some examples, the outsole 300 includes a shape that conforms to the shape and contour of the segments 218*a*, 218*b*, 218*d* (as well as segments 218*c* and 218*e*-*g*) and attaches to the segments 218*a*-218*g* via melding and/or adhesive.

Figure 9:
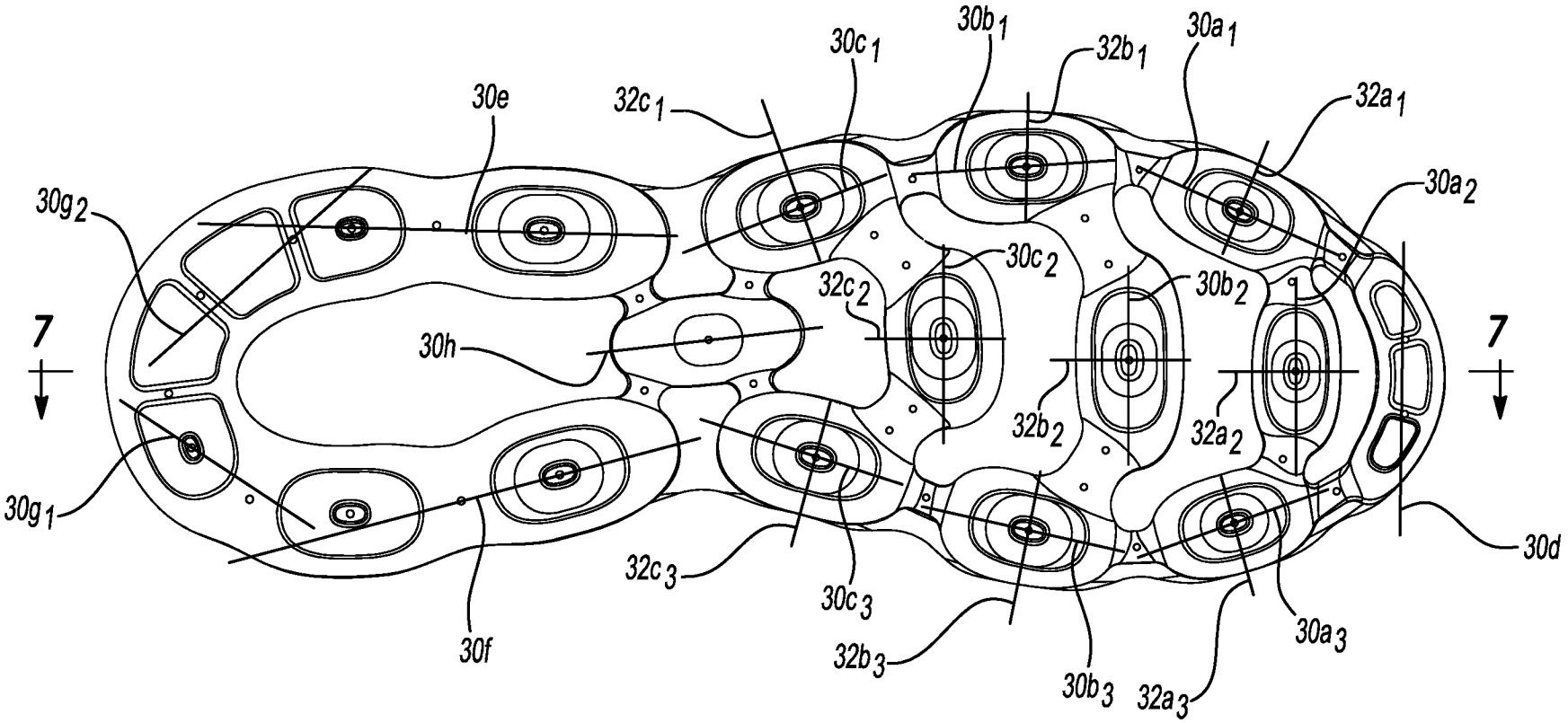
FIG. 9 is a bottom perspective view of the article of footwear of FIG. 1, showing cushioning support vectors defined by a bladder of the sole structure.

FIG. 9 provides a bottom perspective view of the article of footwear 10 of FIG. 1 showing a plurality of cushioning support vectors 30 defined by the segments 218*a*-218*g*. More particularly, a longitudinal axis 30 of each of the segments 218*a*-218*g* define respective ones of the cushioning support vectors 30*a*-30*g*. Applied loads associated with directions parallel to a cushioning support vector cause the one or more corresponding segments to substantially retain their shape without collapsing to provide support and stability for the foot in those regions. On the other hand, applied loads associated with directions transverse to a cushioning support vector cause the one or more corresponding segments to compress and collapse to provide cushioning for the foot in those regions by attenuating the ground-reaction force associated with the applied load. The longitudinal cushioning support vectors 30$a_1$-30$c_1$, 30$a_3$-30$c_3$, 30*e*, 30*f* may extend along the longitudinal axis L of the midsole 200 while the lateral cushioning support vectors 30$a_2$-30$c_2$, 30*d* extend transversely to the longitudinal axis L of the midsole 200. For instance, the lateral cushioning support vectors 30$a_2$-30$c_2$, 30*d* may define angles within 15 degrees (15°) from perpendicular relative to the longitudinal axis L of the midsole 200. The seventh segment 218*g* defines a pair of compound cushioning support vectors 30$g_1$, 30$g_2$, whereby the curved segment 218*g* provides responsive support along both the longitudinal and lateral directions of the midsole 200.

During forward movements, such as walking or running movements, loads applied to the midsole 200 are associated with a direction parallel to the longitudinal cushioning support vectors 30$a_1$-30$c_1$, 30$a_3$-30$c_3$, 30*e*, 30*f* to cause the respective reservoirs 220*a*-220*c*, 224*a*-224*c* and segments 218*e*, 218*f* to be under shear force, thereby causing the respective reservoirs 220*a*-220*c*, 224*a*-224*c* and segments 218*e*, 218*f* to retain their shape (e.g., not compress) and provide support and stability as the outsole rolls for engagement with the ground surface through the heel region 16 and the mid-foot region 14. The web area 210 extending between the reservoirs 220*a*-220*c*, 224*a*-224*c* and segments 218*e*, 218*f* reduces torsional forces from acting upon the reservoirs 220*a*-220*c*, 224*a*-224*c* and segments 218*e*, 218*f* when under applied load to thereby dampen oscillations by the foot while providing gradient responsive-type cushioning.

During lateral movements, such as shifting or cutting movements, loads applied to the midsole 200 are associated with a direction transverse and generally perpendicular to longitudinal cushioning support vectors 30$a_1$-30$c_1$, 30$a_3$-30$c_3$, 30*e*, 30*f*. Thus, the reservoirs 224*a*-224*c* and segment 218*f* defining the vectors 30$a_3$-30$c_3$, 30*f* will compress to provide cushioning for the medial side of the foot when the applied load is in a direction toward the medial side 20 of the midsole 200, while the reservoirs 220*a*-220*c* and segment 218*e* defining the vectors 30$a_1$-30$c_1$, 30*e* will compress to provide cushioning for the lateral side of the foot when the applied load is in a direction toward the lateral side 18 of the midsole 200.

In some implementations, a series of the lateral cushioning support vectors 30$a_2$-30$c_2$, 30*d* are disposed within the mid-foot 14 and forefoot region 12 and extend substantially parallel to one another in a direction transverse to the longitudinal axis L of the midsole 200. During forward movements, such as walking or running movements, loads applied to the midsole 200 are associated with a direction transverse to the lateral cushioning support vectors 30$a_2$-30$c_2$, 30*d*. Thus, the respective reservoirs 222*a*-222*c* and segment 218*d* defining respective ones of the vectors 30$a_2$-30$c_2$, 30*d* successively compress and collapse to provide cushioning for the metatarsal region of the foot through push off from the ground-surface. The direction of the vectors 30$a_2$-30$c_2$, 30*d* relative to the direction of the applied load as well as a length of the respective reservoirs 222*a*-222*c* and segment 218*d* dictates how the segments will compress for attenuating the ground-reaction force.

During lateral movements, such as shifting or cutting movements, loads applied to the midsole 200 are associated with a direction generally parallel or only slightly transverse to the lateral cushioning support vectors 30$a_2$-30$c_2$, 30*d* to cause the respective reservoirs 222*a*-222*c* and segment 218*d* to be under shear force, thereby causing the respective reservoirs 222*a*-222*c* and segment 218*d* to retain the their shape (e.g., not compress or slightly compress) and provide support and stability for the metatarsal region of the foot responsive to the footwear 10 performing a lateral movement.

As provided above, the seventh segment 218*g* further defines a pair of compound cushioning support vector 30$g_1$, 30$g_2$ which are each configure to provide a degree of both longitudinal cushioning and responsiveness and lateral cushioning and responsiveness, thereby supplementing the lateral cushioning support vectors 30$a_2$-30$c_2$, 30*d* and the longitudinal cushioning support vectors 30$a_1$-30$c_1$, 30$a_3$-30$c_3$, 30*e*, 30*f*.

The segments 218*a*-218*g* associated with the chambers 212, 214, 216 may cooperate to enhance the functionality and cushioning characteristics that a conventional midsole provides, while simultaneously providing increased stability and support for the foot by dampening oscillations of the foot that occur in response to a ground-reaction force during use of the footwear 10. For instance, an applied load to the midsole 200 during forward movements, such as walking or running movements, may cause some of the segments 218*a*-218*g* to compress to provide cushioning for the foot by attenuating the ground-reaction force, while other segments 218*a*-218*g* may retain their shape to impart stability and support characteristics that dampen foot oscillations relative to the footwear 10 responsive to the initial impact of the ground-reaction force.

Moreover, one or more of the segments 218*a*-218*g* may interact with the web area 210 within different regions 12, 14, 16 of the midsole 200 to provide isolated areas of responsive-type cushioning. For example, the segments 218*e*-218*g* within the heel region 16 may bound a respective portion of the web area 210 to provide responsive-type cushioning in the heel region 16 by causing the segments 218*e*-218*g* around the perimeter of the heel region 16 to absorb the initial impact of a ground-reaction force by creating a trampoline effect as portions of the segments 218*e*-218*g* compress in succession, and thereby provide a gradient responsive-type cushioning in the heel region 16.

Additionally, the geometry and positioning of the segments 218*a*-218*g* along the midsole 200 may enhance traction between the outsole 300 and the ground surface during forward movements as the outsole 300 rolls for engagement with the ground surface from the heel region 16 to the forefoot region 12, as well as during lateral movements as the outsole 300 rolls for engagement with the ground surface from one of the lateral side 18 and the medial side 20 to the other one of the lateral side 18 and the medial side 20.

The following Clauses provide an exemplary configuration for an article of footwear described above.

Clause 1: A sole structure for an article of footwear having an upper, the sole structure comprising a heel region, a forefoot region including a toe portion, a mid-foot region disposed between the heel region and the forefoot region, and a bladder including a first barrier layer cooperating with a second barrier layer to define a first chamber bounding a periphery of the heel region, and a second chamber extending from the mid-foot region through the forefoot region and including a plurality of segments extending from a medial side of the sole structure to a lateral side of the sole structure.

Clause 2: The sole structure of Clause 1, wherein each of the segments of the second chamber includes a medial reservoir adjacent to the medial side and a lateral reservoir adjacent to the lateral side, the medial reservoir fluidly coupled to the lateral reservoir via a first conduit.

Clause 3: The sole structure of Clause 2, wherein each of the segments further includes a central reservoir disposed between the medial reservoir and the lateral reservoir.

Clause 4: The sole structure of Clause 3, further comprising an outsole attached to the bladder and including a plurality of contact pads, wherein each of the contact pads is formed on one of the reservoirs.

Clause 5: The sole structure of Clause 3, wherein the medial reservoir is fluidly coupled to the central reservoir via the first conduit and the lateral reservoir is coupled to the central reservoir via a second conduit.

Clause 6: The sole structure of Clause 3, wherein the medial reservoir defines a prolate hemispheroid shape having a major axis extending in a direction along the medial side, the lateral reservoir defines a prolate hemispheroid shape having a major axis extending in a direction along the lateral side, and the central reservoir defines a prolate hemispheroid shape having a major axis intersecting the major axis of the medial reservoir and the major axis of the lateral reservoir.

Clause 7: The sole structure of Clause 6, wherein the plurality of segments includes a first segment, a second segment, and a third segment, the second segment disposed intermediate the first segment and the third segment along a longitudinal direction.

Clause 8: The sole structure of Clause 7, wherein the central reservoir of the third segment is disposed between the medial reservoir and the lateral reservoir of the second segment.

Clause 9: The sole structure of Clause 8, wherein the central reservoir of the second segment is disposed between the medial reservoir and the lateral reservoir of the first segment.

Clause 10: The sole structure of Clause 7, wherein the medial reservoir of the first segment is fluidly coupled to the medial reservoir of the second segment by a third conduit and the lateral reservoir of the first segment is fluidly coupled to the lateral reservoir of the second segment by a fourth conduit.

Clause 11: A sole structure for an article of footwear having an upper, the sole structure comprising a heel region, a forefoot region including a toe portion, a mid-foot region disposed between the heel region and the forefoot region, and a first chamber extending from the mid-foot region through the forefoot region and including a plurality of ribs extending from a medial side of the sole structure to a lateral side of the sole structure, each of the ribs including a medial reservoir formed along a medial side of the sole structure, a lateral reservoir formed along a lateral side of the sole structure, and a central reservoir disposed between the medial reservoir and the lateral reservoir.

Clause 12: The sole structure of Clause 11, wherein the medial reservoir of each of the ribs defines a major axis extending along the medial side of the sole structure, the lateral reservoir of each of the ribs defines a major axis extending along the lateral side of the sole structure, and the central reservoir of each of the ribs defines a major axis extending transvers to a longitudinal axis of the sole structure.

Clause 13: The sole structure of Clause 12, wherein each of the ribs includes a lateral conduit fluidly coupling the central reservoir to the lateral reservoir and a medial conduit fluidly coupling the central reservoir to the medial reservoir.

Clause 14: The sole structure of Clause 11, wherein the first chamber includes a first rib, a second rib, and a third rib, the second rib disposed between the first rib and the second rib along a longitudinal axis of the sole structure.

Clause 15: The sole structure of Clause 14, wherein the lateral reservoir of the first rib is fluidly coupled to the lateral reservoir of the second rib by a first conduit and the lateral reservoir of the second rib is fluidly coupled to the lateral reservoir of the third rib by a second conduit.

Clause 16: The sole structure of Clause 15, wherein the medial reservoir of the first rib is fluidly coupled to the medial reservoir of the second rib by a third conduit and the medial reservoir of the second rib is fluidly coupled to the medial reservoir of the third rib by a fourth conduit.

Clause 17: The sole structure of Clause 11, wherein the central reservoir of a first one of the ribs is disposed between the medial reservoir and the lateral reservoir of a second one of the ribs.

Clause 18: The sole structure of Clause 11, wherein a major axis defined by the central reservoir of one of the ribs is disposed forward of minor axes defined by the medial reservoir and the lateral reservoir of the one of the ribs.

Clause 19: The sole structure of Clause 11, wherein the first chamber further includes a first segment extending around the forefoot region from the medial side to the lateral side and coupled to the medial reservoir of a first one of the ribs by a first conduit and the lateral reservoir of the first one of the ribs by a second conduit.

Clause 20: The sole structure of Clause 19, further comprising a second chamber surrounding the heel region and a third chamber disposed intermediate the first chamber and the second chamber in the mid-foot region of the sole structure.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a heel region;

a forefoot region including a toe portion;

a mid-foot region disposed between the heel region and the forefoot region; and a bladder including a first barrier layer cooperating with a second barrier layer to define (i) a first chamber defining a first segment extending along a medial side of the sole structure in the heel region, a second segment extending along a lateral side of the sole structure in the heel region, a third segment extending between and connecting the first segment and the second segment and along a posterior end of the sole structure in the heel region, and a web area extending continuously in the heel region between the first segment, the second segment, and the third segment and from the third segment to the mid-foot region, and (ii) a second chamber extending from the mid-foot region through the forefoot region and including a plurality of segments extending from the medial side of the sole structure to the lateral side of the sole structure, each of the segments of the plurality of segments including a plurality of reservoirs.

2. The sole structure of claim 1, wherein each of the segments of the second chamber includes a medial reservoir adjacent to the medial side and a lateral reservoir adjacent to the lateral side, each segment's respective medial reservoir fluidly coupled to each segment's respective lateral reservoir via a first conduit.

3. The sole structure of claim 2, wherein each of the segments of the second chamber further includes a central reservoir disposed between the respective segment's medial reservoir and the respective segment's lateral reservoir.

4. The sole structure of claim 3, further comprising an outsole attached to the bladder and including a plurality of contact pads, wherein each of the contact pads is formed on a respective one of the reservoirs.

5. The sole structure of claim 3, wherein, within the plurality of segments, each segment's respective medial reservoir is fluidly coupled to each segment's respective central reservoir via each segment's respective first conduit and each segment's respective lateral reservoir is coupled to each segment's respective central reservoir via a second conduit of the respective segment.

6. The sole structure of claim 3, wherein, within the plurality of segments, each segment's respective medial reservoir includes a prolate hemi spheroid shape having a major axis extending in a direction along the medial side, each segment's respective lateral reservoir includes a prolate hemispheroid shape having a major axis extending in a direction along the lateral side, and each segment's respective central reservoir includes a prolate hemispheroid shape having a major axis intersecting the major axis of each segment's respective medial reservoir and the major axis of each segment's respective lateral reservoir.

7. The sole structure of claim 6, wherein the plurality of segments includes a first segment, a second segment, and a third segment, wherein, within the plurality of segments, the second segment is disposed intermediate the first segment and the third segment along a longitudinal direction.

8. The sole structure of claim 7, wherein, within the plurality of segments, the central reservoir of the third segment is disposed between the medial reservoir of the second segment and the lateral reservoir of the second segment.

9. The sole structure of claim 8, wherein, within the plurality of segments, the central reservoir of the second segment is disposed between the medial reservoir of the first segment and the lateral reservoir of the first segment.

10. The sole structure of claim 7, wherein, within the plurality of segments, the medial reservoir of the first segment is fluidly coupled to the medial reservoir of the second segment by a second conduit and the lateral reservoir of the first segment is fluidly coupled to the lateral reservoir of the second segment by a third conduit.

11. A sole structure for an article of footwear having an upper, the sole structure comprising:

a heel region;

a forefoot region including a toe portion;

a mid-foot region disposed between the heel region and the forefoot region;

a first chamber extending from the mid-foot region through the forefoot region and including a plurality of ribs extending from a medial side of the sole structure to a lateral side of the sole structure, each of the ribs including a medial reservoir formed along the medial side of the sole structure, a lateral reservoir formed along the lateral side of the sole structure, and a central reservoir disposed between the medial reservoir and the lateral reservoir, the central reservoir of each of the ribs being offset forwardly from the respective medial reservoir and the respective lateral reservoir;

a second chamber surrounding the heel region; and a third chamber disposed intermediate the first chamber and the second chamber in the mid-foot region of the sole structure, the third chamber defining a major axis extending substantially parallel to a longitudinal axis of the sole structure and fluidly connecting the first chamber and the second chamber.

12. The sole structure of claim 11, wherein the medial reservoir of each of the ribs defines a major axis extending along the medial side of the sole structure, the lateral reservoir of each of the ribs defines a major axis extending along the lateral side of the sole structure, and the central reservoir of each of the ribs defines a major axis extending transverse to the longitudinal axis of the sole structure.

13. The sole structure of claim 12, wherein each of the ribs includes a respective lateral conduit fluidly coupling the respective central reservoir to the respective lateral reservoir and a respective medial conduit fluidly coupling the respective central reservoir to the respective medial reservoir.

14. The sole structure of claim 11, wherein the first chamber includes a first rib, a second rib, and a third rib, the second rib disposed between the first rib and the third rib along the longitudinal axis of the sole structure.

15. The sole structure of claim 14, wherein the lateral reservoir of the first rib is fluidly coupled to the lateral reservoir of the second rib by a first conduit and the lateral reservoir of the second rib is fluidly coupled to the lateral reservoir of the third rib by a second conduit.

16. The sole structure of claim 15, wherein the medial reservoir of the first rib is fluidly coupled to the medial reservoir of the second rib by a third conduit and the medial reservoir of the second rib is fluidly coupled to the medial reservoir of the third rib by a fourth conduit.

17. The sole structure of claim 11, wherein the central reservoir of a first one of the ribs is disposed between the medial reservoir of a second one of the ribs and the lateral reservoir of the second one of the ribs.

18. The sole structure of claim 11, wherein a major axis defined by the central reservoir of one of the ribs is disposed forward of minor axes defined by the medial reservoir and the lateral reservoir of the one of the ribs.

19. The sole structure of claim 11, wherein the first chamber further includes a first segment extending around the forefoot region from the medial side to the lateral side and coupled to the medial reservoir of a first one of the ribs by a first conduit and the lateral reservoir of the first one of the ribs by a second conduit.

* * * * *